United States Patent [19]

de Villers

[11] 4,188,890

[45] Feb. 19, 1980

[54] SPORTS EQUIPMENT RACK

[76] Inventor: Bill de Villers, 5110 Jeanne D'Arc, Montreal, Quebec, Canada

[21] Appl. No.: 848,750

[22] Filed: Nov. 4, 1977

Related U.S. Application Data

[63] Continuation of Ser. No. 729,206, Oct. 4, 1976.

[51] Int. Cl.[2] ..... A47B 81/00

[52] U.S. Cl. ..... 108/30; 211/123

[58] Field of Search ..... 108/29, 30, 31; 211/123, 90

[56] References Cited

U.S. PATENT DOCUMENTS

| | | | |
|---|---|---|---|
| 1,021,838 | 4/1912 | Kinney | 108/29 |
| 1,286,588 | 12/1918 | Goodykoontz | 108/29 |
| 1,596,296 | 8/1926 | Oberdorfer | 108/30 |
| 2,859,879 | 11/1958 | Rogers et al. | 211/90 |
| 2,947,423 | 8/1960 | Ekst rom | 108/30 |

*Primary Examiner*—Francis K. Zugel

[57] ABSTRACT

A sports equipment storage rack comprising two parallel vertical support members with a transverse forwardly extending top support member secured to a top end of each of the vertical support members. A shelf is secured above the top supports and extends therebetween. A support bar extends between the top supports and spaced forwardly of the vertical support members. One or more transverse members are secured between the vertical support members. Hook members are secured to the vertical support members and the transverse members.

3 Claims, 5 Drawing Figures

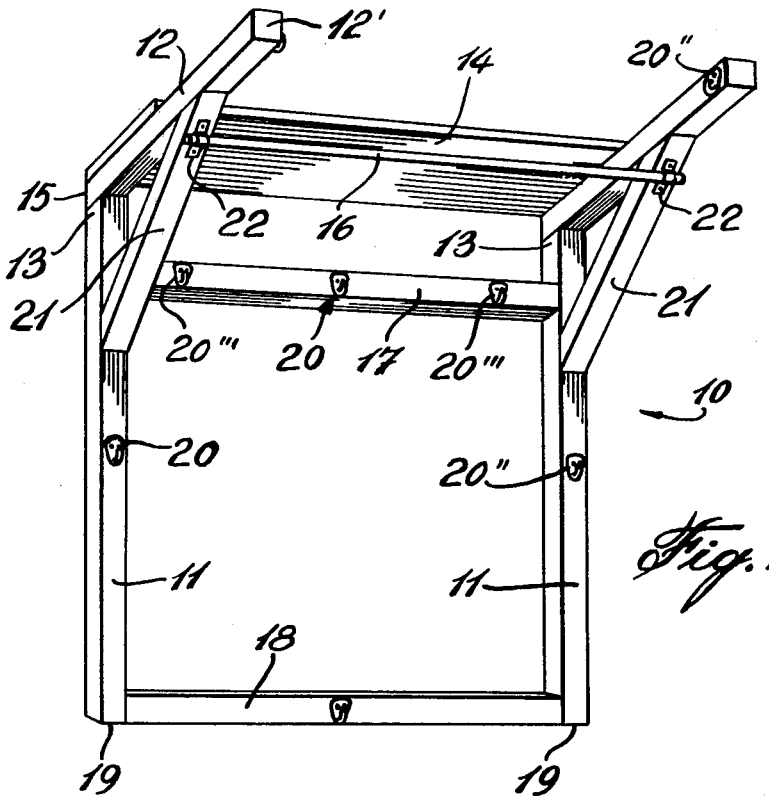
Fig. 1
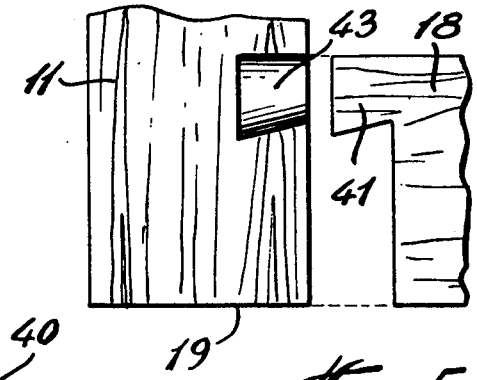
Fig. 5
Fig. 4
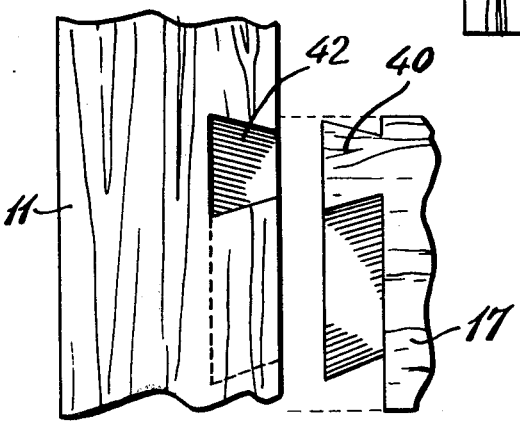

SPORTS EQUIPMENT RACK

This is a continuation of application Ser. No. 729,206 filed Oct. 4, 1976.

BACKGROUND OF THE INVENTION (a) Field of the Invention

The present invention relates to a storage rack and more particularly, but not exclusively, to a rack to support sports equipment.

(b) Description of Prior Art

Sports activities today are well organized and participants, of all ages, utilize special sports equipment to participate in these activities. For example, with the sport of hockey, the participant must wear sports equipment apparel to protect nearly all parts of the body because of the dangerous aspect of such sport. It is important that the participant wear such equipment in order to minimize the risk of being injured during the sport activity.

Today, children participate in organized sports, such as hockey, as early as five years old and it is important that they wear the proper sports equipment in order of prevent injury. Often, children misplace items of their equipment as after participation the equipment is normally laid out to dry as some of the equipment becomes soiled with sweat or mud, particularly if the activity is played outdoors in the rain or on an ice surface. Often, a person will misplace a piece of their equipment and will not notice that the particular piece of equipment is missing until they are away from home dressing themselves immediately prior to playing a game of hockey, for instance. Because of a misplaced piece of equipment, the person may not be able to participate, or he may participate in only a portion of the activity as he must find a replacement part for the missing equipment. Further, often the soiled equipment is not hung to dry properly and moisture within the material will cause it to deteriorate more quickly.

SUMMARY OF THE INVENTION

It is, therefore, a feature of the present invention to provide a storage rack for sports equipment which will permit sports equipment pieces to be correlated.

It is a further feature of the present invention to provide a storage rack for sports equipment which will support sports equipment pieces in a manner whereby these will be ventilated and dry more rapidly when wet.

It is a further feature of the present invention to provide a sports equipment rack which is easy to construct, economical, and which can be utilized by young children.

It is a still further feature of the present invention to provide a storage rack for sports equipment apparel of all types.

It is a still further feature of the present invention to provide a storage rack for sports equipment which is compact and which may be easily assembled, requiring no special tools.

According to the above features, from a broad aspect, the present invention provides a storage rack for sports equipment comprising two parallel vertical support members with a transverse forwardly extending top support member secured to a top end of each of the vertical support members. A shelf is secured above the top supports and extends therebetween. A support bar extends between the top supports and spaced forwardly of the vertical support members. One or more transverse members are secured between the vertical support members. Attachment means are secured to the vertical support members and the transverse members.

BRIEF DESCRIPTION OF THE DRAWINGS

A preferred embodiment of the present invention will now be described with reference to the examples thereof as illustrated by the accompanying drawings in which:

FIG. 1 is a perspective view of the storage rack;

FIG. 4 is a fragmented exploded view showing a connector of the top transverse member; and FIG. 5 is a sectional exploded view showing a connector of the bottom transverse member.

DESCRIPTION OF PREFERRED EMBODIMENTS

Figure 2:
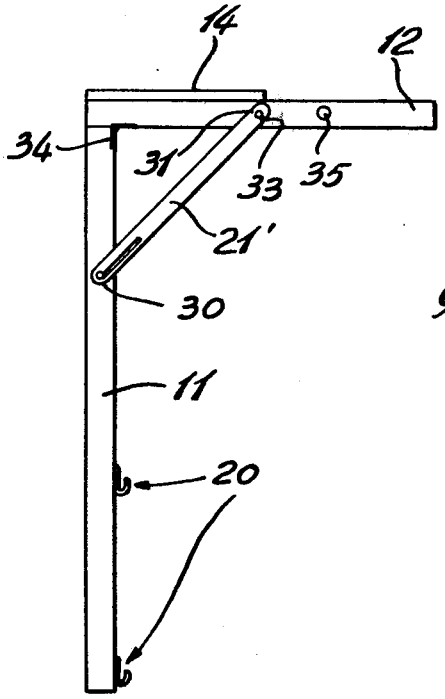
FIG. 2 is a side view of a storage rack of the collapsible type.

Referring now to the drawings, and more particularly to FIG. 1, there is shown generally at 10, the sports equipment storage rack of the present invention. The rack comprises essentially two parallel vertical support members 11, with a transverse forwardly extending top support member 12 secured to a top end 13 of each vertical support 11. A shelf 14 is secured above the top supports 12 and extends thereacross from a rear edge 15 of the top support 12. A support bar 16 is secured and extends between the top supports 12 and spaced forwardly of the vertical support members 11. A top transverse member 17 is secured between the vertical members 11 spaced a short distance from the top ends 13 of the vertical members. A second transverse member 18 is also secured between the vertical support members 11 adjacent their bottom ends 19. Attachment means, herein hook members 20, are secured to the vertical members 11, the transverse members 17 and 18, and the top support members 12.

A bridge member 21 is secured between the vertical support members 11 and an associated top support member 12 whereby to support the top support members in a more rigid manner. As shown in FIG. 1, the support bar 16 is secured at opposed ends to the bridge members 21 by means of the securement bracket 22 attached to the bridge members 21.

Referring now to FIGS. 2 to 5, there is shown, a collapsible version of the sports equipment storage rack 10. As hereinshown, the bridge member 21 is constituted by a bridge link arm 21', herein an elongated flat metal bar being hingeably secured at one end 30, in a convenient manner, to the vertical member 11 and detachably connected at an opposed end 31 to a pin or screw 32 secured to a top support member 12. The end 31 of the link 21' is provided with a slot 33 having a throat or narrow slot opening to receive the screw head 32 therein in a securable manner whereby to support the top support members 12 substantially transverse to the vertical supports 11.

As more clearly illustrated in FIG. 2, the top support members 12 are each connected to a respective vertical support member 11 by means of a hinge 34. Thus, by disconnecting the bridge link arms 21' from their respective top support members 12, the top support members 12 and the shelf 14 will collapse onto the vertical support members 11 as shown in FIG. 2. Also, as shown in this embodiment, the support bar 16 is secured between aligned through bores 35 in the top support members 12.

Figure 3:
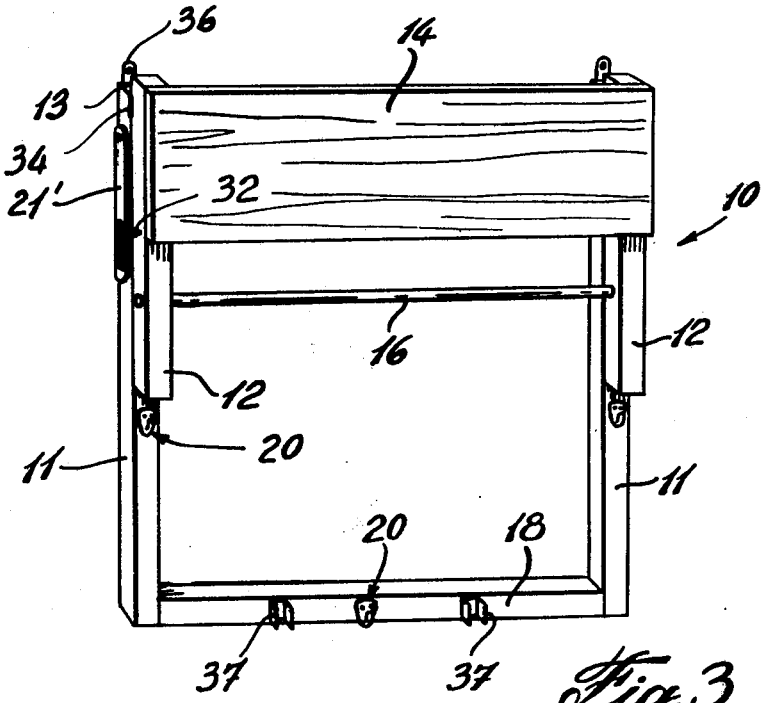
FIG. 3 is a perspective front view of the storage rack of FIG. 2.

As clearly illustrated in FIG. 3, the storage rack 10 is secured to a vertical wall by wall attachment brackets 36 which may be secured adjacent the top end 13 of the vertical support members 11, when the rack is provided in a collapsible version, or to a rear edge of the shelf 14 or the rear edge of the top support members 12, when the rack is provided in a rigid structure, as shown in FIG. 1. As further shown in FIG. 3, a plurality of attachment clamps 37 may be secured to the bottom transverse member 18 to provide retention of hockey sticks (not shown) thereto or other types of elongated sports equipment, such as fishing rods, etc. In the case of fishing rods, the attachment clamps 37 would have a different configuration.

Referring now to FIGS. 4 and 5, there is shown one manner of connecting the top and bottom transverse members 17 and 18 to the vertical support members 11. The attachment means shown in FIGS. 4 and 5 makes it possible to easily assemble or dismantle the sports equipment rack. As hereinshown, the top and bottom transverse members 17 and 18 are each provided with a male connecting projection 40 and 41 respectively at their opposed ends, for sliding engagement in connecting slots 42 and 43 respectively, provided in adjacently facing faces of the two vertical support members. The male connecting projections and the connecting slots may be angulated, as shown in FIG. 4, to provide more rigidity or be horizontally extending as shown in FIG. 5. The male connecting projections have an outward taper and the female slots have an inward taper whereby the male connecting projection cannot be drawn out sideways of its associated connection slot.

Referring now to FIG. 1, the utility of the hook members 20 will now be described with reference to hockey sports equipment, as an example. With many sports such as hockey, special type of shoes or boots are provided. The hook members 20' are secured adjacent the free ends 12' of the top support members 12 and face inwardly. Boots such as skates, are hung thereon away from the rack and other sports equipment are attached to the other hook members. There are two such hooks 20', as sports equipment shoes come in pairs. These are also clearly visible whereby to readily identify that both boots are present and these also are positioned outwardly to remind the person to verify the boots to see that they are in proper condition i.e. in the case of skates to make sure that the skate blades are verified to determine that they are sharpened. The hockey pants are normally supported by the suspenders which are held between the hook members 20'' secured to the vertical support members whereby the pants will extend below the rack 10 to be ventilated. The shoulder pads are supported between the hook members 21''' of the top transverse support member 17 and the elbow pads are also secured on such hook members. The head gear may be attached to the center hook member 20 on the top support member 17. The shirt is hung from the support bar 16 and the socks are hung from the hook members 20''. The gloves may also be hung from the hook members 20'' or placed on top of the shelf 14. It can be seen that with this type of rack, a child can organize his sports equipment after use, serving a double purpose, (1) to dry the equipment which is often wet, and (2) to make sure that all the equipment is present and that none is lost or misplaced. Also, the rack will prevent children from leaving their equipment on the floor or on furniture throughout the house.

A typical dimension of the sports equipment rack as shown in FIG. 1 consists in the vertical support members 11, the transverse supports 17 and 18, and the top support members 12, all being constructed of lumber having 21 inches in length and one-and-a-half inches in square cross-section. The top shelf is a flat piece of lumber twenty-four inches in length and approximately nine inches in width. The transverse members 21 may be from twelve to eighteen inches in length, also cut from one-and-a-half inch square cross-section lumber. The support bar 16 may be a wooden or metal bar. Also, the rack may be painted a colour which is the colour of the team that the child is associated with. The storage rack also is meant to give the child a feeling of professionalism by displaying his sports equipment and maintaining it in good condition.

Thus, it will be appreciated that this sports equipment rack will give children more pride in their sports equipment, will prevent the children from scattering their sports equipment throughout the house, and sometimes losing some of their equipment, provide a neater appearance in the home, and permit the equipment to dry when wet thereby preserving the equipment.

Still further, the sports equipment rack will deter displays of anxiety by parents towards their children when it is discovered that a strategic piece of equipment has been forgotten at home. These displays of anxiety usually lead to a great disturbance in the child's concentration and usually results in a poor showing on the child's part in whatever sport he may be participating. The equipment rack of this invention permits, prior to the execution of a specific sports event, the child to view, at a glance, all his equipment placed upon the rack whereby to ascertain that all the equipment needed is there and can be packed into a sports equipment bag for transportation to the site of the proposed sports event.

I claim:

1. A storage rack for attachment and support of sports equipment and apparel, said rack comprising two parallel vertical support members, a transverse forwardly extending top support member immovably secured to a top end of each of said two parallel vertical support members, a shelf above said top supports and extending therebetween over a rear portion thereof, support bar means extending between said top supports and spaced forwardly of said shelf for hanging depending articles of said sports equipment for ventilation, a first transverse member between said vertical support members adjacent a top end thereof, a second transverse member extending across said vertical support members at a bottom end thereof; said vertical support members, said two transverse members and said top support members are of identical rectangular cross-section and of equal lengths; a bridge member extending and immovably secured between each of said vertical support members and an associated top support member, and attachment members secured to a forward face of said vertical support members and said first and second transverse members and projecting outwardly thereof, a further attachment member secured near a forward end of each said forwardly extending top support members forwardly of said support bar means and on an inward face thereof; all of said attachment members being predeterminately spaced and oriented relative to one another whereby to support individual articles of said sports equipment in an open area for ventilation of same and in a manner to correlate said sports equipment normally including paired articles.

2. A storage rack as claimed in claim 1 wherein there is further provided wall attachment means secured to said rack, and securement means in said attachment means to secure said rack to a vertical wall.

3. A storage rack as claimed in claim 1 wherein said rack is a hockey equipment rack, all of said attachment members and said support bar and shelf being oriented to support individual articles of hockey equipment in a spaced-apart manner and to permit correlation thereof.

* * * * *